US006827210B2

(12) United States Patent
Chen

(10) Patent No.: US 6,827,210 B2
(45) Date of Patent: Dec. 7, 2004

(54) TOOL HANGER WITH LOCKING DEVICE

(76) Inventor: Terence Chen, No. 325, Yung Ching Road, Tung Shan Hsiang, Lo Tung Town, Yi Lan Hsien (TW)

( * ) Notice: Subject to any disclaimer, the term of this patent is extended or adjusted under 35 U.S.C. 154(b) by 142 days.

(21) Appl. No.: 10/303,185

(22) Filed: Nov. 25, 2002

(65) Prior Publication Data

US 2004/0099553 A1 May 27, 2004

(51) Int. Cl.[7] ..... B65D 75/56; A45C 11/26
(52) U.S. Cl. ..... 206/349; 206/376; 206/495; 206/806
(58) Field of Search ..... 206/376, 378, 206/372, 349, 464–465, 468, 806, 495; 211/70.6

(56) References Cited

U.S. PATENT DOCUMENTS 6,241,092 B1 * 6/2001 Vasudeva ..... 206/349
6,425,482 B1 * 7/2002 Chiang ..... 206/349
6,679,379 B1 * 1/2004 Kao ..... 206/349

FOREIGN PATENT DOCUMENTS

FR 2701458 A1 * 8/1994 ..... B65D/73/00

* cited by examiner

*Primary Examiner*—Byron P. Gehman
(74) *Attorney, Agent, or Firm*—Alan D. Kamrath; Nikolai & Mersereau, P.A.

(57) ABSTRACT

A hanger includes a first board, a second board foldable to the first board for retaining a tool between them and a locking device for locking the second board to the first board. The locking device includes a first flexible strip extending from the first or second board and a second flexible strip extending from the first or second board. A plurality of ratchets is formed on the first flexible strip. A sleeve is formed on the second flexible strip. A ratchet is formed on an internal face of the sleeve. The first flexible strip can be inserted in the sleeve so that one of the ratchets formed on the first flexible strip is engaged with the ratchet formed on the second flexible strip. The locking device includes two slots defined in the second or first board for receiving the first and second flexible strips. The first or second board defines at least one slot, and the second or first board includes at least one hook for insertion through the at least one slot for engagement with first or second board. The first board defines a recess, and the second board defines a recess, the recesses together make a space for holding the tool when the second board is folded to the first board.

20 Claims, 7 Drawing Sheets

TOOL HANGER WITH LOCKING DEVICE

BACKGROUND OF INVENTION

1. Field of Invention

The present invention relates to a hanger with a locking device for locking a wrench thereto.

2. Related Prior Art

Taiwanese Patent No. 313940 discloses a hanger 10 consisting of a board 11 and a buckle 16 connected with the board 11. The buckle 16 can be pivotally moved to the board 11 for holding a wrench between them. The board 11 defines a window 13. A hook 18 is formed on the buckle 16. The hook 18 can be inserted through the window 13 into engagement with a portion of the board 11. However, the hook 18 can be easily disengaged from the edge 14 so that a wrench can be easily taken from the hanger 10 and stolen.

The present invention is therefore intended to obviate or at least alleviate the problem encountered in the prior art.

SUMMARY OF INVENTION

It is the primary objective of the present invention to provide a hanger with a locking device for locking a wrench thereto.

According to the present invention, a hanger includes a first board, a second board foldable to the first board for retaining a tool between them and a locking device for locking the second board to the first board. The locking device includes a first flexible strip extending from the first or second board and a second flexible strip extending from the first or second board. A plurality of ratchets is formed on the first flexible strip. A sleeve is formed on the second flexible strip. A ratchet is formed on an internal face of the sleeve. The first flexible strip can be inserted in the sleeve so that one of the ratchets formed on the first flexible strip is engaged with the ratchet formed on the second flexible strip. The locking device includes two slots defined in the second or first board for receiving the first and second flexible strips. The first or second board defines at least one slot, and the second or first board includes at least one hook for insertion through the at least one slot for engagement with first or second board. The first board defines a recess, and the second board defines a recess, the recesses together make a space for holding the tool when the second board is folded to the first board.

Other objectives, advantages, and novel features of the invention will become more apparent from the following detailed description when taken in conjunction with the attached drawings.

BRIEF DESCRIPTION OF DRAWINGS

The present invention will be described through detailed illustration of embodiments referring to the attached drawings.

DETAILED DESCRIPTION OF EMBODIMENTS

Figure 1:
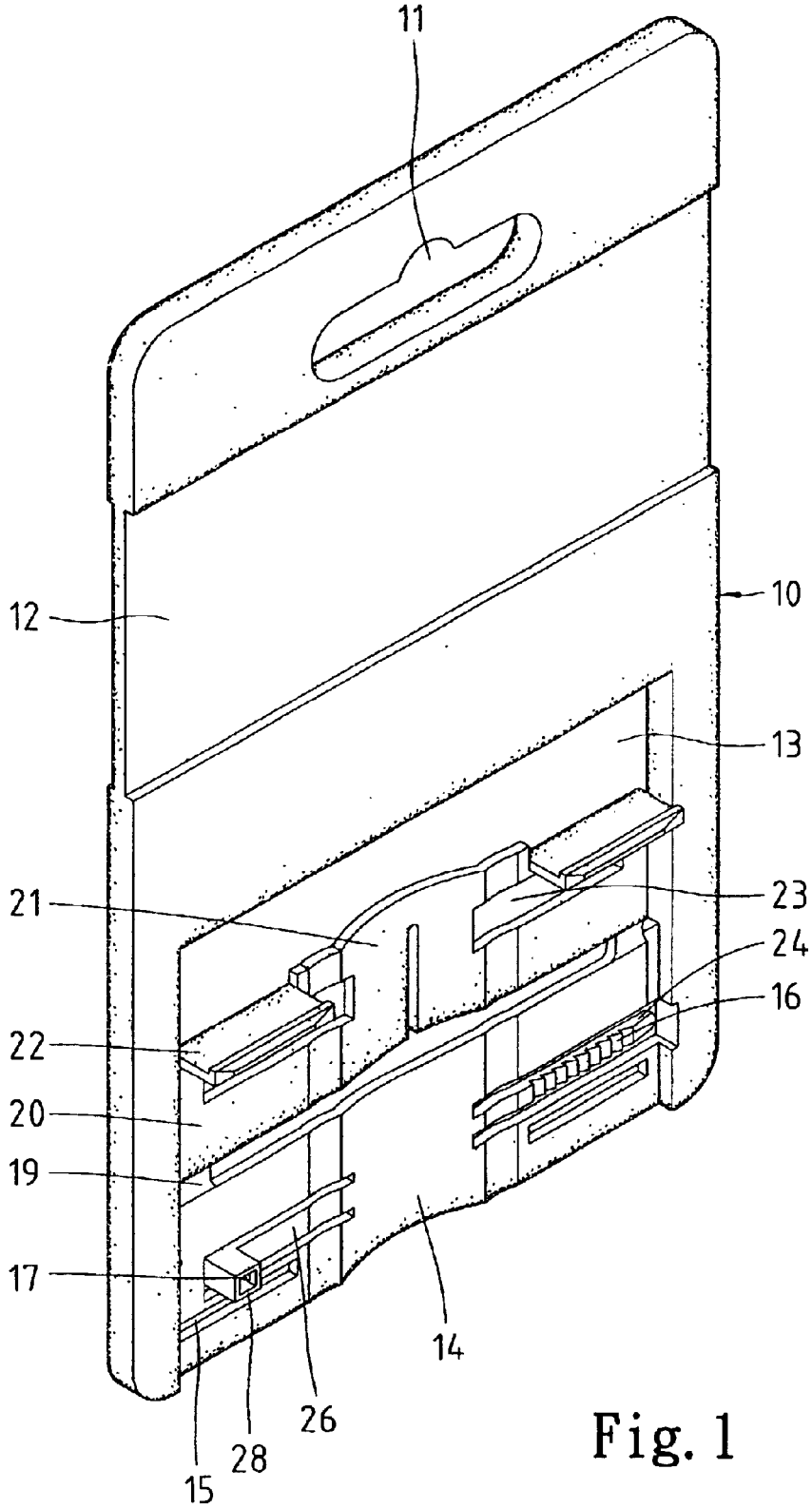
FIG. 1 is a perspective view of a hanger for holding a wrench according to a first embodiment of the present invention.
Figure 2:
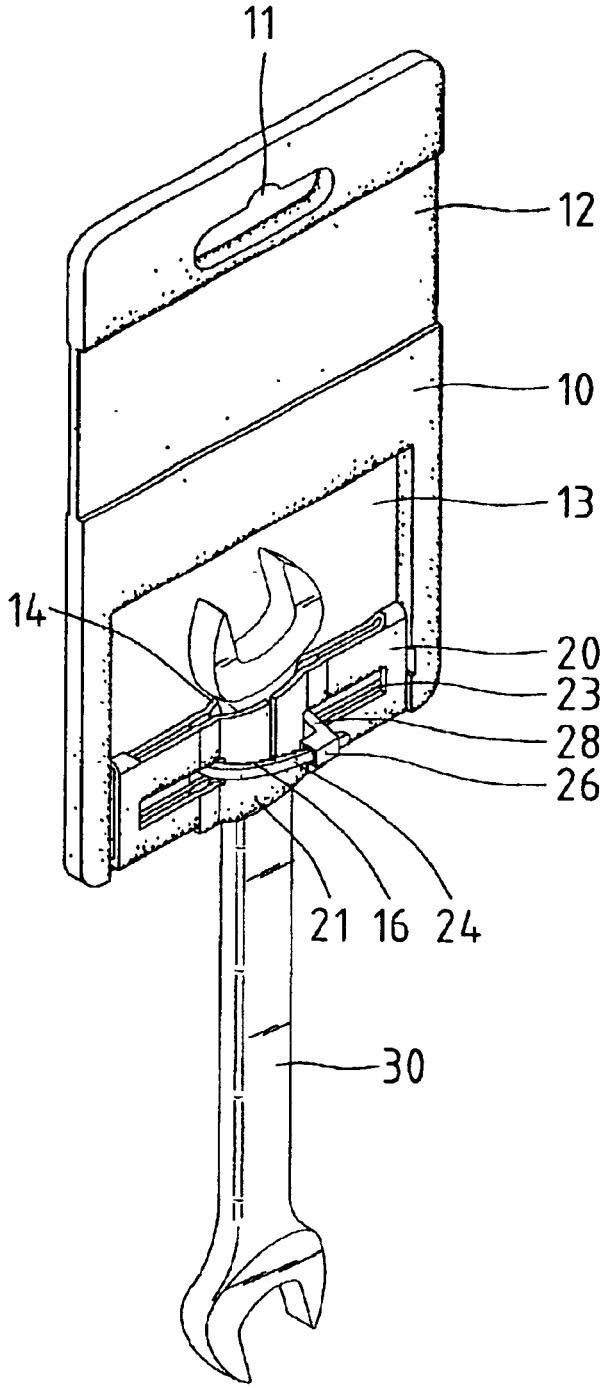
FIG. 2 is a front-left-top perspective view of a wrench held by means of the hanger of FIG. 1.
Figure 3:
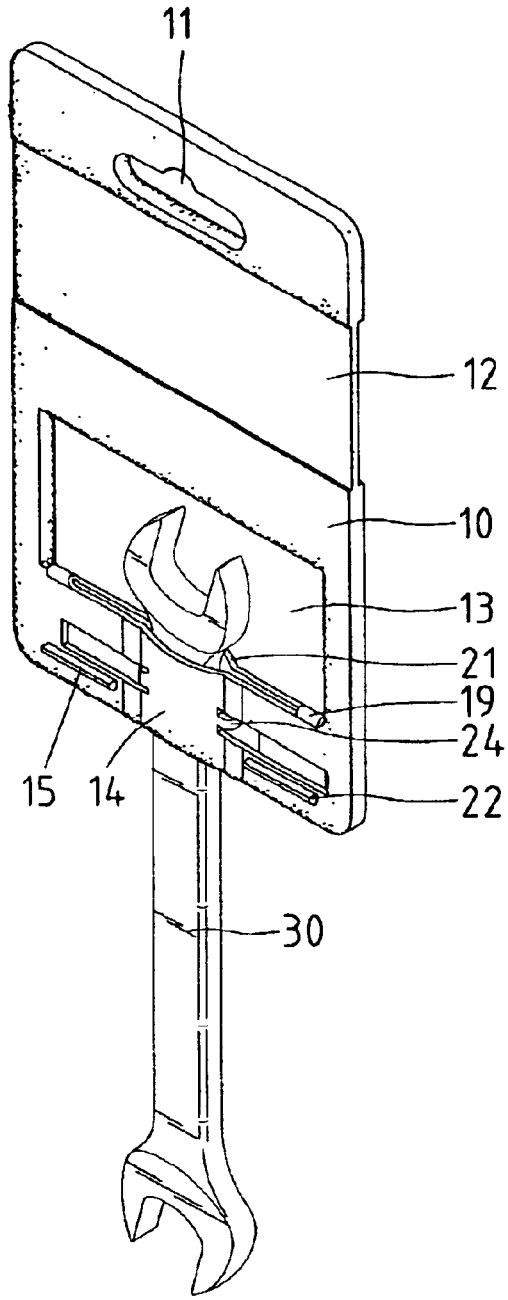
FIG. 3 is a rear-left-top perspective view of the wrench and the hanger of FIG. 2.
Figure 4:
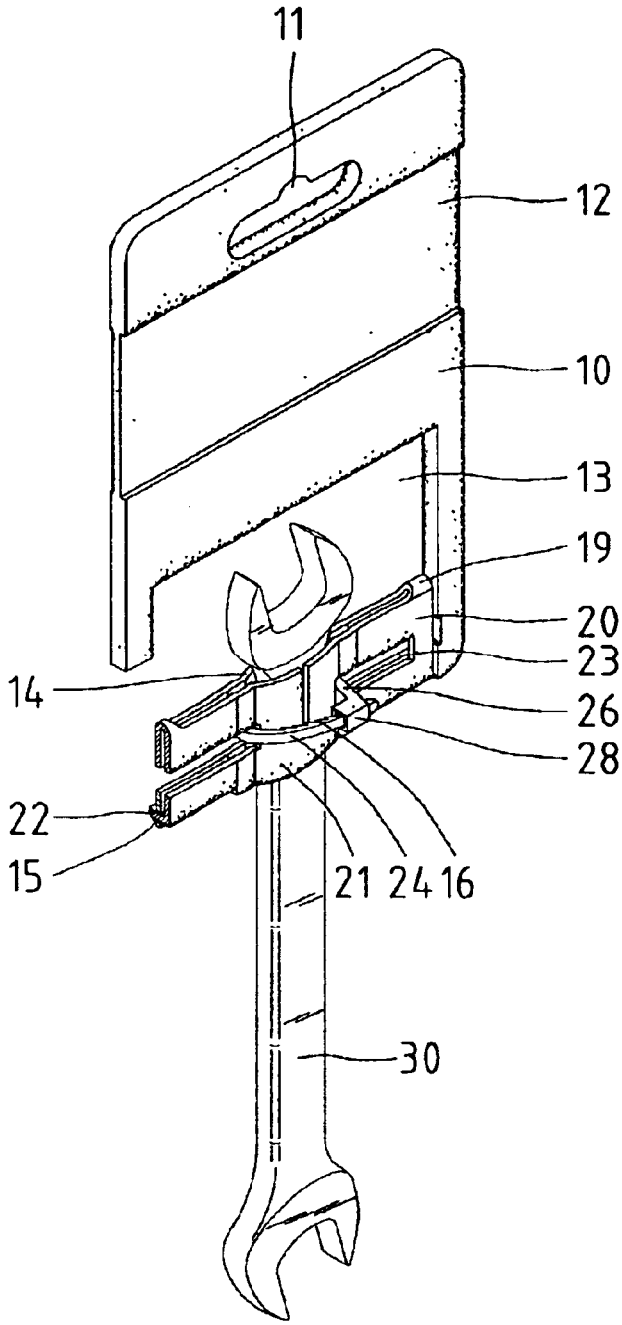
FIG. 4 is similar to FIG. 2 but showing the hanger broken so that some structural details can be revealed.
Figure 5:
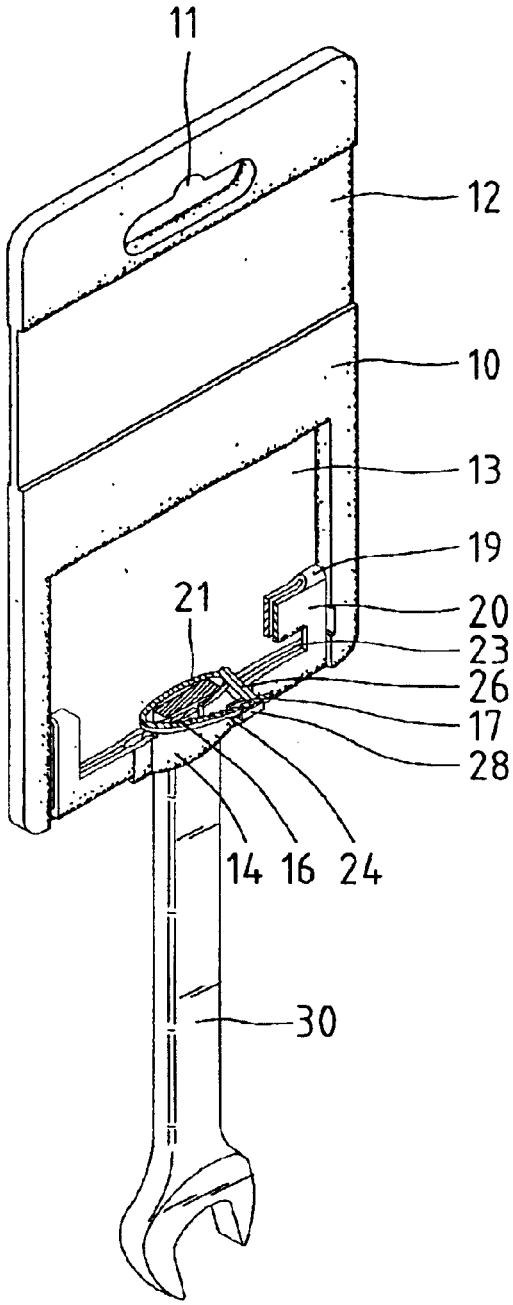
FIG. 5 is similar to FIG. 2 but showing the hanger broken so that some structural details can be revealed.

Referring to FIGS. 1–5, according to a first embodiment of the present invention, a hanger includes a first board 10 and a second board 20 foldable to the first board 10 for holding a wrench 30 between the first board 10 and the second board 20.

The first board 10 has a first section, a second section, a third section and a fourth section from top to bottom. A hole 11 is defined in the first section of the first board 10 so that the first board 10 can be hung on a nail mounted on a wall. A recess 12 is defined in the second section of the first board 10 in order to receive a rag on which information about the wrench 30 is provided. A window 13 is defined in the third section of the first board 10. A recess 14 is defined in the fourth section of the first board 10. The fourth section of the first board 10 defines two slots 15 on two opposite sides of the recess 14. The fourth section of the first board 10 is formed with a flexible strip 24 on a side of the recess 14 and a flexible strip 26 on an opposite side of the recess 14. A plurality of ratchets 16 is formed on the flexible strip 24. A sleeve 28 is formed at a free end of the flexible strip 26. A ratchet 17 is formed on an internal face of a sleeve 28.

A second board 20 is connected with the fourth section of the first board 10 via a connector 19. In the first embodiment, the connector 19 is a flexible strip formed between the fourth section of the first board 10 and the second board 20. The connector 19 is thinner than the fourth section of the first board 10 and the second board 20 in order to provide flexibility so that the second board 20 can be folded towards the fourth section of the first board 10. The connector 19 defines a slot (not numbered) in order to improve its flexibility. However, the connector 19 can be a hinge in another embodiment.

The second board 20 defines a recess 21 corresponding to the recess 14. The second board 20 is formed with two hooks 22 corresponding to the slots 15. The second board 20 defines two slots 23 corresponding to the flexible strips 24 and 26, the ratchets 16 and the sleeve 28.

The second board 20 is located in the window 13 when idle. In use, the second board 20 is folded to the fourth section of the first board 10 as shown in FIGS. 2~5. The recesses 14 and 21 together make a space for receiving the wrench 30. A head of the wrench 30 is located in the window 13. The hooks 22 are inserted through the slots 15. Each of the hooks 22 is engaged with an edge of one of the slots 15 so as to retain the second board 20 folded to the fourth section of the first board 10. The flexible strip 24 is inserted through one of the slots 23. and the flexible strip 26 the remaining one of the slots 23. The flexible strip 24 is inserted through the sleeve 28. Thus, one of the ratchets 16 is engaged with the ratchet 17 so as to ensure that the second board 20 can be folded to the fourth section of the first board 10. The engagement of one of the ratchets 16 with the ratchet 17 cannot be released unless one of the elastic strips 24 and 26 is torn from the fourth section of the first board 10.

Figure 6:
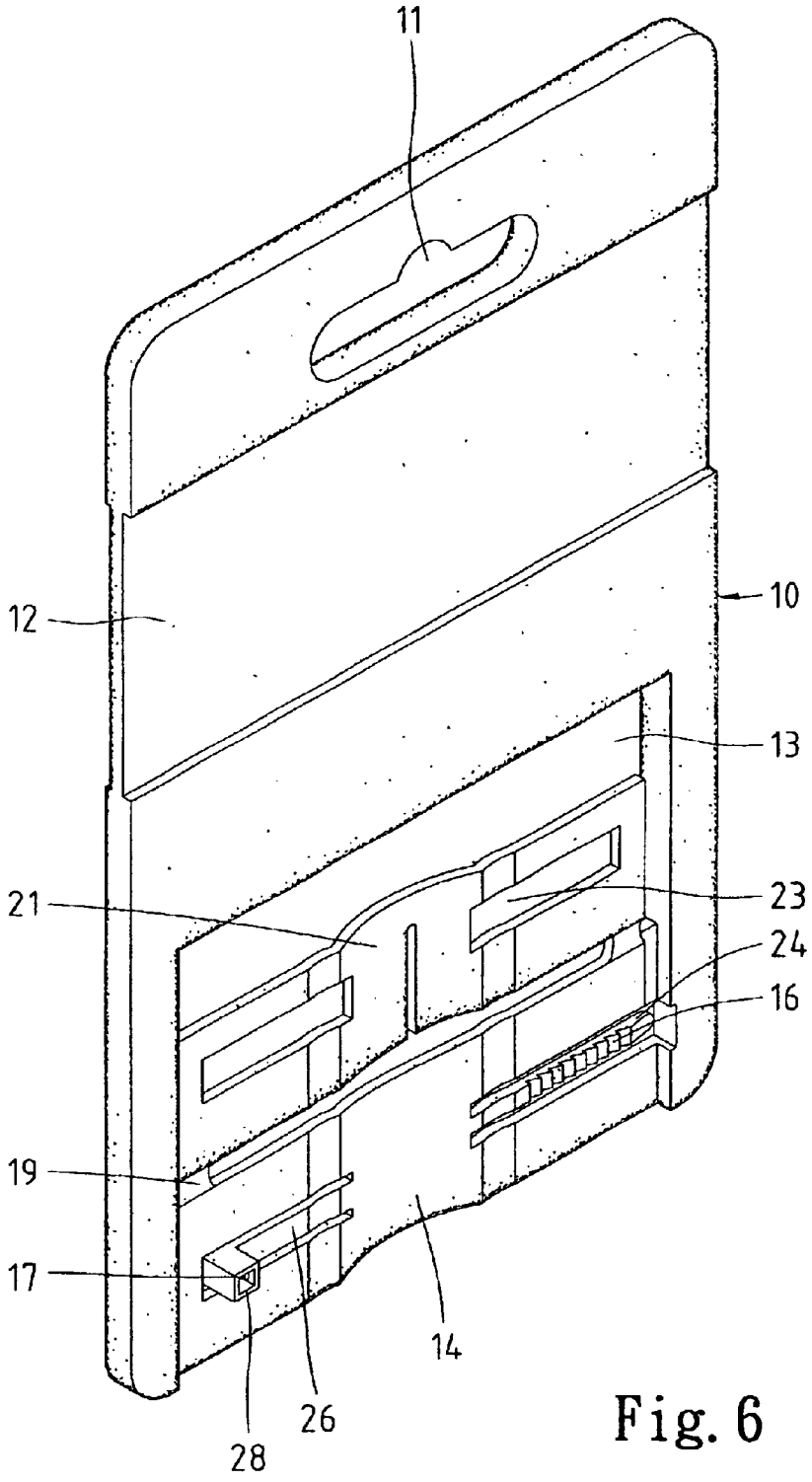
FIG. 6 is a perspective view of a hanger for holding a wrench according to a second embodiment of the present invention.

FIG. 6 shows a hanger according to a second embodiment of the present invention. The second embodiment is identical to the first embodiment except for eliminating the hooks 22 and the slots 15.

Figure 7:
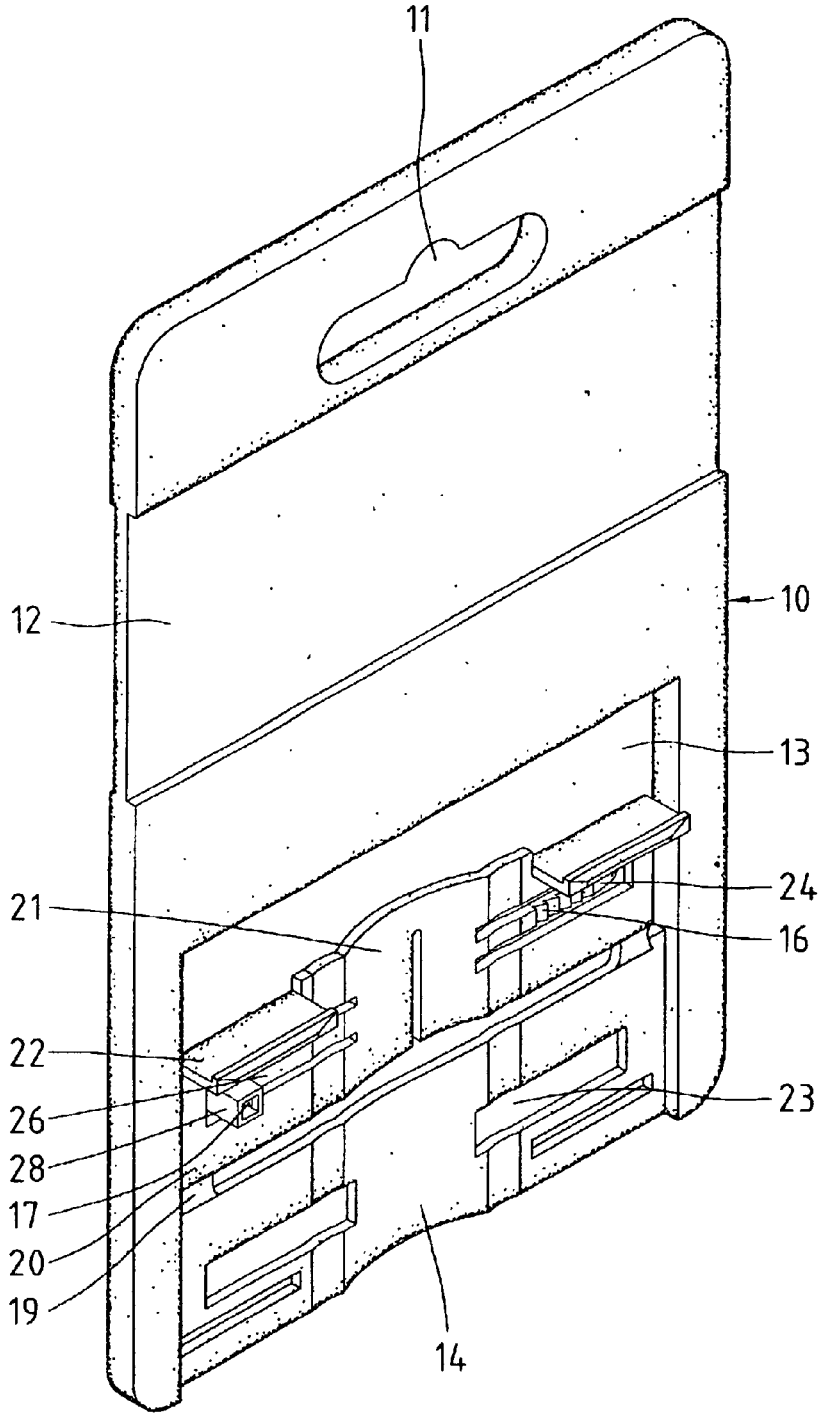
FIG. 7 is a perspective view of a hanger for holding a wrench according to a third embodiment of the present invention.

FIG. 7 shows a hanger according to a third embodiment of the present invention. The third embodiment differs from the first embodiment except in that the slots 23 are defined in the fourth section of the first board 10 and that the flexible strips 24 and 26 are formed on the second board 20.

The present invention has been described via illustration of some embodiments thereof. After a study of this specification, those skilled in the art can derive various variations from the embodiments. Therefore, the embodiments are only taken as examples and shall not limit the scope of the present invention that is defined in the following claims.

What is claimed is:

1. A hanger including a first board, a second board pivotally movable to the first board for retaining a tool between them and a locking device for locking the second board to the first board, wherein the locking device includes a sleeve formed on one of the first and second boards, a ratchet formed on an internal face of the sleeve, a flexible strip extending from said one of the first and second boards for insertion in the sleeve and a plurality of ratchets formed on the flexible strip for engagement with the ratchet, wherein the locking device includes two slots defined in the remaining one of the first and second boards for receiving the flexible strip and the sleeve.

2. The hanger according to claim 1 wherein the two slots are defined in the first board for receiving the flexible strip and the sleeve, and wherein the sleeve is formed in the second board.

3. The hanger according to claim 1 wherein the two slots are defined in the second board for receiving the flexible strip and the sleeve, and wherein the sleeve is formed in the first board.

4. The hanger according to claim 1 wherein the one of the first and second boards defines at least one slot, and the remaining one of the first and second boards includes at least one kook for insertion through the at least one slot for engagement with first board.

5. The hanger according to claim 4 wherein the first board defines at least one slot, and the second board includes at least one hook for insertion through the at least one slot for engagement with the first board.

6. The hanger according to claim 1 wherein the first board defines a recess, and the second board defines a recess, the recesses make a space for receiving the tool when the second board is pivotally moved to the first board.

7. The hanger according to claim 1 including a connector for connecting the first board with the second board.

8. The hanger according to claim 7 wherein the connector is a flexible strip formed between the first board and the second board.

9. The hanger according to claim 1 wherein the first board defines a window in which the second board is located when the second board is pivoted away from the first board.

10. A hanger including a first board, a second board pivotally movable to the first board for retaining a tool between them and a locking device for locking the second board to the first board, wherein the locking device includes a sleeve formed on one of the first and second boards, a ratchet formed on an internal face of the sleeve, a flexible strip extending from said one of the first and second boards for insertion in the sleeve and a plurality of ratchets formed on the flexible strip for engagement with the ratchet, wherein the locking device includes a second flexible strip extending from a remaining one of the first and second boards, and the sleeve is formed on the second flexible strip.

11. The hanger according to claim 10 wherein the second flexible strip extends from the second board.

12. The hanger according to claim 11 wherein the locking device includes two slots defined in the first board for receiving the first and second flexible strips.

13. The hanger according to claim 10 wherein the second flexible strip extends from the first board.

14. The hanger according to claim 13 wherein the locking device includes two slots defined in the second board for receiving the first and second flexible strips.

15. The hanger according to claim 10 wherein the one of the first and second boards defines at least one slot, and the remaining one of the first and second boards includes at least one hook for insertion through the at least one slot for engagement with first board.

16. The hanger according to claim 15 wherein the first board defines at least one slot, and the second board includes at least one hook for insertion through the at least one slot for engagement with the first board.

17. The hanger according to claim 10 wherein the first board defines a recess, and the second board defines a recess, the recesses make a space for receiving the tool when the second board is pivotally moved to the first board.

18. The hanger according to claim 10 including a connector for connecting the first board with the second board.

19. The hanger according to claim 18 wherein the connector is a flexible strip formed between the first board and the second board.

20. The hanger according to claim 10 wherein the first board defines a window in which the second board is located when the second board is pivoted away from the first board.

* * * * *